United States Patent [19]

Spitaler

[11] 4,411,446

[45] Oct. 25, 1983

[54] RELEASE BINDING

[75] Inventor: Engelbert Spitaler, Wr. Neudorf, Austria

[73] Assignee: TMC Corporation, Baar, Switzerland

[21] Appl. No.: 242,819

[22] Filed: Mar. 11, 1981

[30] Foreign Application Priority Data

Mar. 19, 1980 [AT] Austria ..... 1480/80

[51] Int. Cl.[3] ..... A63C 9/08

[52] U.S. Cl. ..... 280/628

[58] Field of Search ..... 280/628, 626, 623, 616, 280/611, 633, 634, 621, 630, 631, 632, DIG. 12

[56] References Cited

U.S. PATENT DOCUMENTS

| | | | |
|---|---|---|---|
| 3,462,165 | 8/1969 | Brunner | 280/630 |
| 3,610,647 | 10/1971 | Smolka | 280/623 |
| 3,876,219 | 4/1975 | Smolka et al. | 280/628 |
| 3,920,256 | 11/1975 | Sittmann | 280/628 X |
| 4,243,246 | 1/1981 | Weigl | 280/628 |
| 4,358,132 | 11/1982 | Beyl | 280/628 |

FOREIGN PATENT DOCUMENTS

| | | | |
|---|---|---|---|
| 2340420 | 2/1975 | Fed. Rep. of Germany | 280/628 |
| 2637871 | 3/1978 | Fed. Rep. of Germany | 280/628 |
| 2482864 | 11/1981 | France | 280/628 |

*Primary Examiner*—Joseph F. Peters, Jr.
*Assistant Examiner*—Mitchell J. Hill
*Attorney, Agent, or Firm*—Flynn, Thiel, Boutell & Tanis

[57] ABSTRACT

A release binding has a swivel element mounted on a base plate and a support member supported on the swivel element for pivotal movement about a vertical axis. A housing with a sole holder is pivotally supported on the support member by a horizontal axle. A notch carrier is supported for reciprocal horizontal movement in the support member and has a sector-shaped notch with a curved recess at the apex thereof. An upright extension is provided on the swivel element and a spring urges the notch carrier into engagement therewith. Engagement of the extension with side surfaces of the notch recess inhibits pivotal movement of the support element. Cam surfaces provided on the housing are engaged by the notch carrier so as to resist a pivotal release movement of the housing, during which movement the cam surfaces displace the notch carrier against the force of the spring, thereby disengaging the extension from the notch recess.

9 Claims, 6 Drawing Figures

6
5d
5b
5a
5c
4
III
1a
15
14
12
10
13
7
11
8
21a
30
20
16
17
22
18
1
3
6
9
5c
5a
5
5d
4
2
19
23

RELEASE BINDING

FIELD OF THE INVENTION

The invention relates to a release binding which includes a base plate, a support member supported on the base plate for pivotal movement about an axis which is normal to the upper side of the ski, a housing with a sole holder supported on the support member for pivotal movement about an axis parallel to the upper side of the ski and, in the downhill skiing position, normal to the longitudinal axis of the ski, and a notch carrier supported for movement against the force of a spring on the support member and cooperable with a housing-fixed first locking member to resist the swinging up of the sole holder, the support member being held, by means of a second locking member formed by a notch extending longitudinally of the ski, by an extension which engages the notch and through the force of the mentioned spring, locked in the downhill skiing position against a purely horizontal release force.

BACKGROUND OF THE INVENTION

A release binding of the above-mentioned type is described in Austrian Pat. No. 305 106. In this known construction, the notch carrier has an extension which engages the notch which is constructed in the base plate. Although this release binding overcomes basic problems of a conventional older construction, described in greater detail hereinafter, by providing two separate locking members which permit an all-sided release of the binding only at the moment in which locking engagement is in an associated release direction, it is still disadvantageous that the extension of the notch carrier extends into a notch provided in the base plate, which notch can, in the released condition, be plugged up more or less by snow, ice or the like, which after repeated stepping in can possibly cause the binding not to be fully functional. Therefore, there exists a desire to also provide the second locking member inside of the binding.

Reference has already been made to an older release binding which can release the ski shoe in two directions. This ski binding, described in Swiss Pat. No. 488 467, has a notch carrier which is biased by a spring and engages two locking members. One of these locking members serves to block the movement of the binding upwardly. The other locking member blocks the movement of the binding to the side. If an overload occurs in one direction, then the associated locking member presses back the notch carrier against the force of the spring and, through this movement of the locking carrier, the locking member which blocks movement in the other direction is hereby also released.

During skiing, brief impact loads often occur which do not effect an opening of the binding. This means the binding moves a little, without which the locking engagement would be totally released, and through a spring a return into the centered position occurs. In the case of bindings which open only in one direction and thus have a single locking engagement, such a return after brief impact loads generally functions satisfactorily. However, during an impact load in one direction in the case of the aforedescribed constructions, the locking engagement into the other direction is also loosened. This can cause the ski shoe to also move in the direction in which it is not loaded. From this results an instability of the shoe, which makes the user unsure and can lead to incorrect reactions which could result in a fall.

The purpose of this invention is to keep the advantages of the inner structure of the last-mentioned ski binding and to overcome at the same time the just mentioned disadvantage resulting from the insecure guiding.

SUMMARY OF THE INVENTION

The foregoing purpose is attained inventively by a release binding in which the second locking member is provided or constructed on the notch carrier, in which the extension which engages the notch is constructed on the swivel element supporting the support member and projects from below into the notch, in which the plane of symmetry of the notch carrier, viewed in the downhill skiing position, defines a plane substantially coplanar with a plane of symmetry of the spring which biases it, and in which the notch, as is actually known, is sector-shaped and has in its center a curved recess with side surfaces which extend in the longitudinal direction of the ski, the distance of the side surfaces from one another being substantially equal to the outside dimension of the extension and the depth of engagement of the extension into the recess being substantially equal to the radius of the extension.

The set goal is fully achieved with this inventively constructed release binding. There are no structural parts which could be plugged up with snow or ice so that the functioning of the binding is in question and, at the same time, the advantages of the first-mentioned binding are maintained, in that a single notch carrier with two locking members is used according to the second-mentioned older construction. The design of the notch which is active as a second locking member is known by itself from Austrian Pat. No. 305 843, which circumstance has already been disclosed. Austrian Pat. No. 305 843 corresponds to U.S. Pat. No. 3 876 219.

A particularly advantageous embodiment of the invention consists in the housing-fixed locking member being constructed as two curved cam surfaces which are parallel to one another, are symmetrically positioned about the longitudinal axis of the binding and, viewed in the top view, are the legs of an approximately U-shaped design, wherein the notch carrier which is loaded by the spring has areas which extend normal to the longitudinal axis of the support member and each rest on a respective cam surface. In this manner, it is possible to select or determine the release curve which is the most favorable for each binding type.

A different advantageous embodiment of the invention consists in the extension, in relationship to the axis of the swivel element, being arranged eccentrically, and the extension and the swivel element being a single swivel and control element, preferably a cast piece. In this manner, the entire swivel and control element can be manufactured in a particularly simple and expense-saving manner, and a compact design of the entire binding is also assured.

A further characteristic of the invention consists in the swivel axis having on its area which extends into the base plate at least one shoulder, and preferably two shoulders, which project into a congruent groove in the base plate and secure the swivel element together with the extension against rotation in a horizontal plane. This measure permits compact design of the binding to an increased degree.

It is furthermore important for the invention that the swivel element has above its area which extends into the base plate a bearing portion or collar which is enlarged with respect to same, on which collar the support member is supported rotatably. From this results a particularly simple support for the support member, which support can be achieved without additional expense.

Finally, it is mentioned that through the inventive measure, the spring force which acts onto the notch carrier is fully effective in the downhill skiing position and, during a release operation, eccentric loads occur practically only when vertical and horizontal forces are active simultaneously and also act only through a relatively small lever arm so that of the entire spring force only a relatively small component is applied through forces, mainly friction forces, which do not fall into the direction of the spring force.

A still different thought of the invention consists in the swivel angle of the support member being smaller than the half of the opening angle of the notch, and the notch carrier during a release operation being supported in its rearmost position by the extension. This measure assures that for lateral swings in each direction (right and left), there is provided a stop which prevents full cancellation of the engagement between the extension and notch.

BRIEF DESCRIPTION OF THE DRAWINGS

Further advantages, details and inventively important characteristics of the invention will now be described in greater detail in connection with the drawings, which illustrate one exemplary embodiment.

In the drawings.

DETAILED DESCRIPTION

Figures 1, 5, 6:
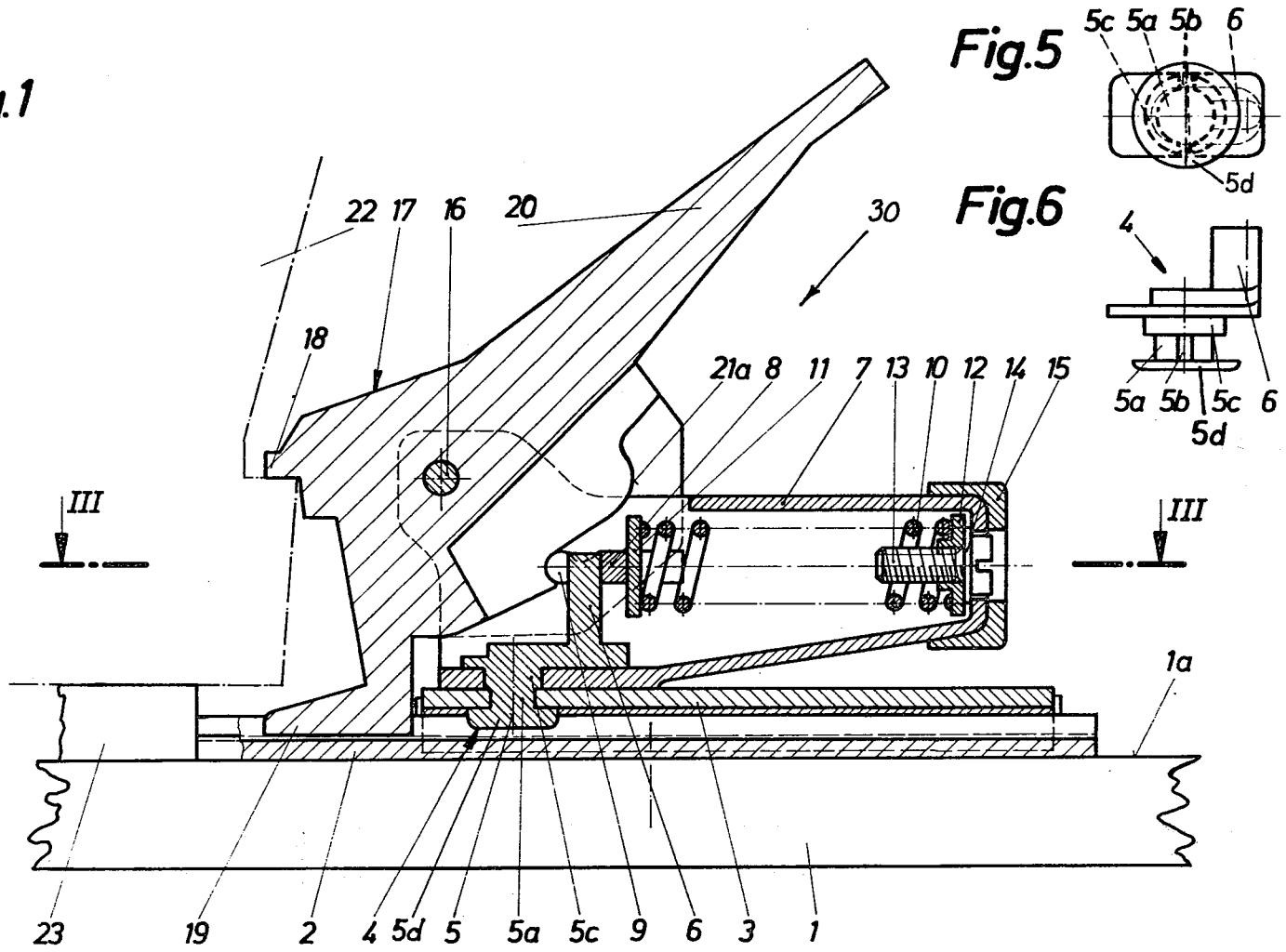
FIG. 1 is a cross-sectional side view of an inventive release binding in the downhill skiing position.
FIGS. 5 and 6 illustrate in associated views a control element which is a component of the release binding, FIG. 5 being a view from below and FIG. 6 being a side view.

On the upper side 1*a* of a ski 1 a release binding 30 is supported on a ski-fixed rail 2 by means of a base plate 3 for adjustment in the longitudinal direction of the ski in a conventional manner to desired positions determined by different size ski shoes, for example, by means of a notch which can from case to case be lockingly engaged with or disengaged from a tooth system of a toothed bar of the rail 2. The locking mechanism is known and not the subject matter of the present invention and is therefore not described in greater detail.

A swivel and control element 4 is supported in the base plate 3, the structure and support of which is described in detail in connection with FIGS. 5 and 6. A support member 7 (FIG. 1) is supported for pivotal movement about the swivel axis 5 of the swivel and control element 4, wherein the bearing portion 5*c* of the element 7 which effects this support has, relative to the kingpin portion 5*a* of the element 4 which projects into the base plate 3, a larger diameter. Two shoulders 5*b* (FIGS. 3 and 5) are constructed diametrically opposite one another on the kingpin portion 5*a* and project into congruent grooves or receiving points 3*a* of the base plate 3. Due to the fact that the two shoulders 5*b* of the element 4 project into the two grooves 3*a* of the base plate, the swivel and control element 4 is secured against rotation in the base plate 3. The swivel and control element 4 is secured against being lifted off from the base plate 3 by an annular flange or abutment 5*d* which engages the underside of the base plate 3. The swivel and control element 4 has an extension 6 which, viewed along the longitudinal direction of the binding, is arranged eccentrically with respect to the swivel axis 5. The extension 6 projects upwardly from the upper side of the swivel and control element 4 and engages a notch 9 in a locking member or notch carrier 8, which carrier 8 is urged forwardly by a helical spring 10 through an interpositioned plate 11. The other end of the spring 10 is supported in a conventional manner on a threaded sleeve 12 which can be adjusted longitudinally of the binding by means of an adjusting screw 13 with which it is threadedly engaged. In this manner, the tension of the spring 10 can be changed to correspond to various needs. The adjusting screw 13 has a collar 14 which is constructed as a hollow member and by means of which the screw 13 is supported on the inner side of the support member 7. The adjusting screw 13 can, in a conventional manner, be operated by means of a screwdriver or a coin. In order to ensure that adjusting or setting or the screw 13 is effected only by a man skilled in the art, the area of the member 7 which supports the adjusting screw 13 is covered by a cap 15. Details of the cap 15 are not part of the subject matter of the present invention.

In other words, the collar 14 prevents the adjusting screw 13 from moving rightwardly in FIG. 1 under the urging of the spring 10, and turning the screw 13 with a screwdriver or other suitable tool causes the sleeve 12 to move axially along the screw 13, thereby increasing or decreasing the tension on the spring 10.

Figure 3:
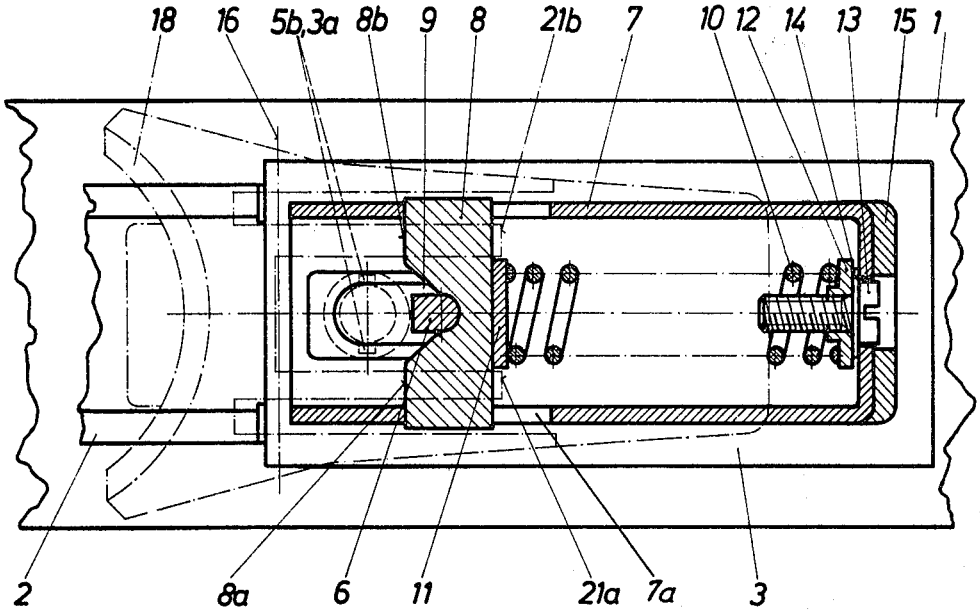
FIG. 3 is a cross-sectional view taken along the line III—III of FIG. 1.

As shown in FIG. 3, the notch carrier 8 extends transversely within the support member 7 and is supported for reciprocal movement in two elongated horizontal slots 7*a* provided in respective side walls of the support member 7, so that the notch carrier 8 moves within a plane which is substantially parallel to the upper side of the ski and its plane of symmetry is substantially coplanar with a plane of symmetry of the spring 10.

A structural part identified in its entirety as a housing 17 is supported pivotally on an axle 16. The axle 16 is arranged parallel to the upper side of the ski and, in the downhill skiing position, normal to the longitudinal axis of the ski, and is mounted in the upper, front area of the support member 7. The housing 17 has a sole holder 18, a stepping spur 19 and a release lever 20. The housing 17 has in its area which faces the notch carrier 8 a curved portion constructed as two spaced and parallel control or cam surfaces 21*a* and 21*b* which each have a respective notch releasably engageable, under the urging of the spring 10, with respective areas or edge surfaces 8*a* and 8*b* of the carrier 8 which extend substantially normal to the direction of movement of the carrier 8, wherein only the notch 21*a*' (FIG. 2) in the cam surface 21*a* is shown in the drawings. Thus, the two cam surfaces 21*a* and 21*b* of the housing 17 define a housing-fixed locking member which is active to prevent the swinging up of the sole holder 18 in relationship to the two areas 8*a*, 8*b* of the notch carrier 8, which areas each cooperate with a respective one of the notches, such as the notch 21a', *in the cam surface 21a* and 21b.

Figure 4:
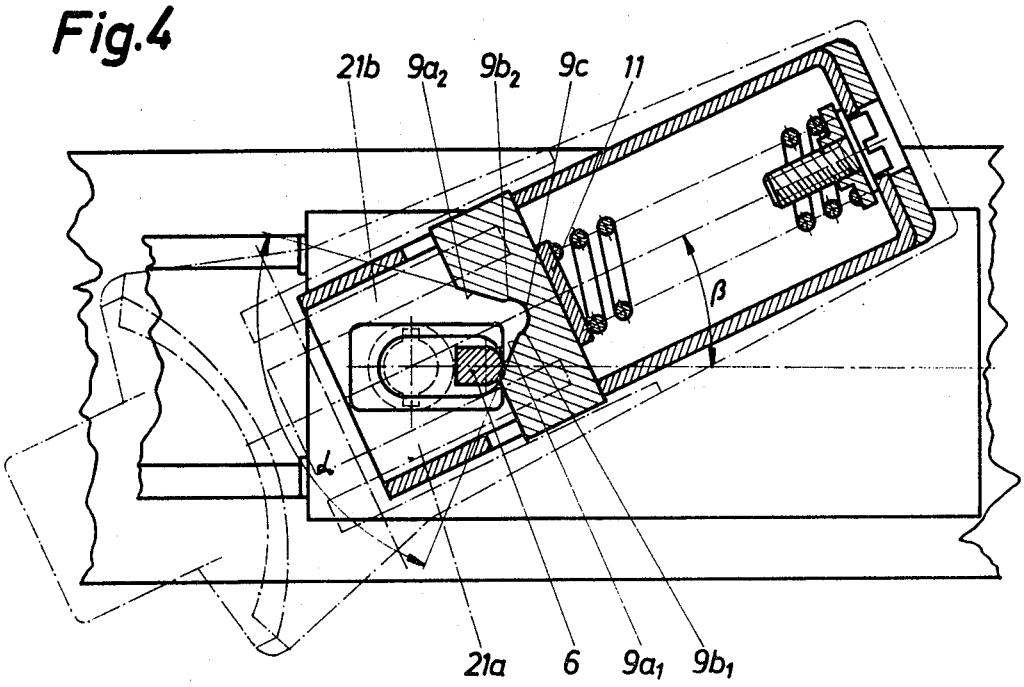
FIG. 4 is a cross-sectional view similar to FIG. 3 after a release caused by simultaneous horizontal and vertical forces.

The notch 9 is sector-shaped or V-shaped and has two notch surfaces $9a_1$ and $9a_2$ (FIG. 4) which define in the direction of the extension 6 an angle $\alpha$ with one another and converge in the center of the notch 9 in a rounded recess 9c, the transition between the two surfaces $9a_1$, $9a_2$ and the recess 9c being defined by side surfaces $9b_1$, $9b_2$ which extend substantially in the longitudinal direction of the ski 1. As shown in FIG. 3, the distance between the side surfaces $9b_1$ and $9b_2$ is substantially equal to the outside dimension of the extension 6 in a transverse direction, and the depth of engagement of the extension 6 into the recess 9c is substantially equal to the radius of the rounded surface on the extension 6, which is substantially equal to the radius of the recess 9c. Thus, relative lateral movement of the extension 6 and notch carrier 8 is not possible until the notch carrier 8 has moved rearwardly a short distance from the position illustrated in FIG. 3 against the urging of the spring 10. The surfaces $9b_1$ and $9b_2$ thus assure that the extension 6 is held immovable in the recess 9c of the slot 9 with respect to purely lateral loads exerted on the binding 30 and cannot transfer any force in response thereto onto the spring 10, as a result of which an unintended or inadvertent release cannot occur.

Figure 2:
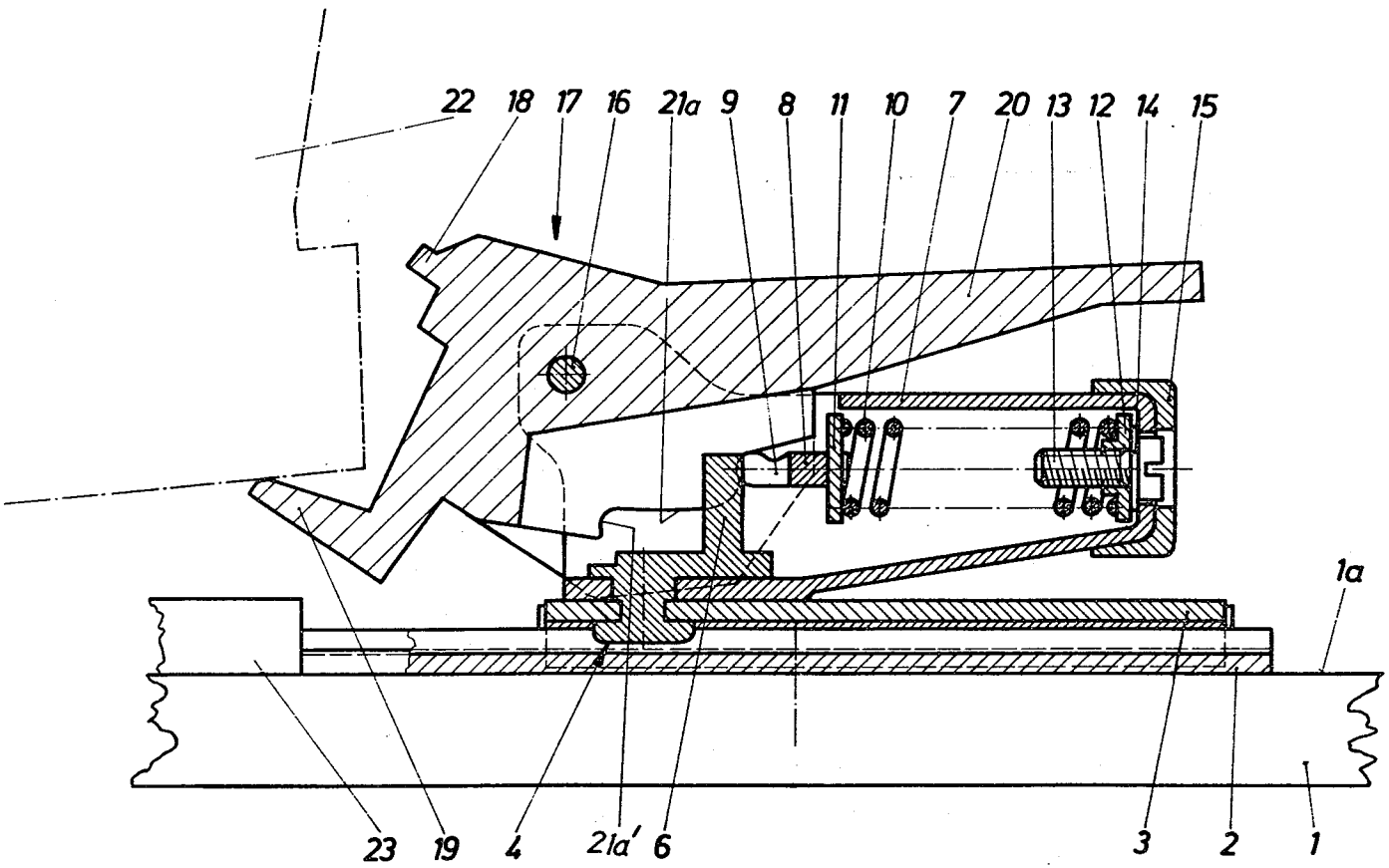
FIG. 2 illustrates the release binding of FIG. 1 in the open position after a purely vertical release operation.

If, however, due for example to upward movement of the shoe 22, a purely horizontal force acts onto the carrier 8 and spring 10 through the curved cam surfaces 21a and 21b, then the housing 17 is pivoted about the axle 16 against the force of the spring 10, as can be taken from FIG. 2. An only indicated ski shoe 22 can be recognized in FIGS. 1 and 2, which ski shoe in the downhill skiing position rests on a heel plate 23 of the ski binding. The heel plate 23 is, in a conventional manner, adjustable together with the binding in the longitudinal direction of the ski 1. The heel plate 23 can, as is also known by itself, be designed as the plate of a ski brake. These measures which are known by themselves are not part of the subject matter of the invention and have been described only to be complete and to show that it is possible to develop or equip the inventive binding in such a manner.

As shown best in FIG. 3, the surface of the extension 6 which faces the carrier 8 is rounded, and preferably has a radius substantially equal to that of the curved recess 9c.

If a horizontal and vertical force acts simultaneously onto the ski shoe 22 and thus onto the binding so that a force acts through the notch carrier 8 onto the spring 10, then in addition to a swinging up of the housing 17 a swivelling of the support member 7 occurs. From the preceding, it follows that such a swivelling can only occur when the notch carrier 8 has been moved rearwardly relative to the extension 6 by the two curved surfaces 21a and 21b of the housing 17 sufficiently far against the force of the spring 10 that lateral swinging out of the support member 7 is possible at all. Care has been taken in the design to ensure that this lateral swivelling does not totally cancel the engagement between the extension 6 and the notch 9 of the notch carrier 8. For this purpose, the swivel angle $\beta$ of the support member 7 is smaller than half of the opening angle $\alpha$ of the notch 9 ($\alpha/2$), the notch carrier 8 being moved during a release operation to its rearmost position by the extension 6.

The binding 30 thus includes two locking mechanisms, one of which includes the cooperating locking member 8 and control surfaces 21a and yieldably resists upward movement of the housing 17 away from the downhill skiing position. The other locking mechanism includes the cooperating extension 6 and notch 9 in locking member 8 and inhibits pivotal movement of the support member 7 and housing 17 about the pivot axis 5 when the housing 17 is in the downhill skiing position and until the housing thereafter moves upwardly a predetermined distance away from the downhill skiing position.

The invention is not limited to the illustrated exemplary embodiment, and various modifications, including the rearrangement of parts, are conceivable without leaving the scope of the invention. For example, the swivel and control element can be manufactured of two parts, even though in the illustrated embodiment the element is constructed as one piece with the receiving parts and the extension integrally connected in or to such part. However, as was mentioned in the beginning, a one-piece design for the swivel and control element is preferable.

The embodiments of the invention in which an exclusive property or privilege is claimed are defined as follows:

1. In a release binding adapted to be mounted on the upper side of a ski, including a base plate, a swivel element supported on said base plate, a support member supported on said swivel element for pivotal movement about a pivot axis which is substantially normal to the upper side of the ski, a housing having a sole holder thereon and supported on said support member for generally vertical movement between released and downhill skiing positions, first locking means for yieldably resisting upward movement of said housing away from said downhill skiing position, said first locking means including a control surface provided on said housing, a locking member which is supported on said support member for movement in directions generally parallel to the longitudinal axis of said ski in said downhill skiing position and which is engagable with said control surface, and resilient means yieldably urging said locking member toward said control surface, and second locking means for inhibiting pivotal movement of said support member and housing about said pivot axis when said housing is in said downhill skiing position and until said housing thereafter moves upwardly a predetermined distance away from said downhill skiing position, the improvement comprising wherein said second locking means includes a substantially V-shaped notch which is provided on said locking member, extends generally longitudinally of the ski in said downhill skiing position, has at its center a recess having a rounded surface and spaced side surfaces adjacent said rounded surface which extend substantially parallel to the longitudinal axis of the ski in said downhill skiing position, and wherein said second locking means further includes an upright extension on said swivel element which is positioned eccentrically with respect to said pivot axis and has a rounded surface which faces and has a radius substantially equal to that of said rounded surface of said recess of said notch, said locking member being urged toward said extension by said resilient means and said extension engaging said recess in said downhill skiing position.

2. The binding according to claim 1, wherein said control surface includes two spaced, curved cam surfaces on said housing which are parallel to one another, and are symmetric in relationship to a vertical plane extending longitudinally of the ski and containing pivot axis; and wherein said resilient means includes a spring and said locking member, which is biased by said spring, has edge surfaces on opposite sides of said notch which extend substantially normal to the direction of movement of said locking member and slidably engage respective said cam surfaces.

3. The binding according to claim 1, wherein said extension is an integral part of said swivel element.

4. The binding according to claim 1 or claim 3, wherein said base plate has an opening therein and has a groove which communicates with the peripheral edge of said opening and said swivel element has on a kingpin portion thereof which extends into said opening in said base plate at least one shoulder which is received in said groove in said base plate and secures said swivel element and said extension against rotation relative to said base plate about a vertical axis.

5. The binding according to claim 1 or claim 3, wherein said swivel element has a kingpin portion which is received in an opening in said base plate, and has thereabove a bearing portion which is of larger diameter than said kingpin portion and on which said support member is pivotally supported.

6. The binding according to claim 1, claim 2 or claim 3, including means for limiting movement of said locking member in a direction against the urging of said resilient means, said locking member being movable by said extension into engagement with said limit means in response to pivotal movement of said housing and support member about pivot axis and cooperation of said extension and locking member then preventing further pivotal movement of said housing and support member about said pivot axis, the range of pivotal movement of said support member being less than the angle of said V-shaped notch.

7. The binding according to claim 1, wherein said support member includes two spaced sidewalls having horizontally extending slots therein and said locking member is a platelike element having opposite edges which are slidably received in respective said slots in said sidewalls of said support member.

8. A release binding adapted to be mounted on the upper side of a ski, comprising a base plate, a swivel element supported on said base plate, a support member supported on said swivel element for pivotal movement about a first axis which is substantially normal to the upper side of the ski, a housing having a sole holder and first locking means thereon and supported on said support member for pivotal movement about a second axis between a released position and a downhill skiing position, said second axis being substantially parallel to the upper side of the ski and, in said downhill skiing position, substantially normal to the longitudinal axis of the ski, a locking member supported for movement on said support member, biased toward said first locking means by a spring, and cooperable with said first locking means for yieldably resisting swinging up of said sole holder away from said downhill skiing position, and second locking means effective in said downhill skiing position for preventing movement of said support member about said first axis in response to a purely horizontal force, said second locking means including a notch provided on said locking member and an upright extension provided on said swivel element and having a curved surface engageable with said notch, said notch being substantially V-shaped and having at its center a curved recess with spaced side surfaces which in said downhill skiing position extend substantially in the direction of the longitudinal axis of the ski, the distance between said side surfaces being substantially equal to the outside dimension of said extension in a direction transverse of the longitudinal axis of the ski, and the depth of engagement of said extension into said recess being substantially equal to the radius of said curved surface of said extension, and wherein said swivel element has a kingpin portion which is received in an opening in said base plate and has thereabove a bearing portion which is larger than said kingpin portion and on which said support member is pivotally supported.

9. A release binding adapted to be mounted on the upper side of a ski, comprising a base plate, a swivel element supported on said base plate, a support member supported on said swivel element for pivotal movement about a first axis which is substantially normal to the upper side of the ski, a housing having a sole holder and first locking means thereon and supported on said support member for pivotal movement about a second axis between a released position and a downhill skiing position, said second axis being substantially parallel to the upper side of the ski and, in said downhill skiing position, substantially normal to the longitudinal axis of the ski, a locking member supported for movement on said support member, biased toward said first locking means by a spring, and cooperable with said first locking means for yieldably resisting swinging up of said sole holder away from said downhill skiing position, and second locking means effective in the downhill skiing position for preventing movement of said support member about said first axis in response to a purely horizontal force, said second locking means including a notch provided on said locking member and an upright extension provided on said swivel element and having a curved surface engageable with said notch, said notch being substantially V-shaped and having at its center a curved recess with spaced side surfaces which in said downhill skiing position extend substantially in the direction of the longitudinal axis of the ski, the distance between said side surfaces being substantially equal to the outside dimension of said extension in a direction transverse of the longitudinal axis of the ski, and the depth of engagement of said extension into said recess being substantially equal to the radius of said curved surface of said extension, wherein the range of angular movement of said support member is less than the angle of said V-shaped notch, including means for limiting movement of said locking member in a direction against the urging of said spring, and wherein said locking member is moved, during a release operation, into engagement with said limit means by said extension.

* * * * *

UNITED STATES PATENT AND TRADEMARK OFFICE

CERTIFICATE OF CORRECTION

PATENT NO. : 4 411 446

DATED : October 25, 1983

INVENTOR(S) : Engelbert Spitaler

It is certified that error appears in the above-identified patent and that said Letters Patent is hereby corrected as shown below:

Column 6, line 40; change "engagable" to ---engageable---.

Column 7, line 1; after "containing" insert ---said---.

Column 7, line 31; after "about" insert ---said---.

Signed and Sealed this

*Fifteenth* Day of *May 1984*

[SEAL]

*Attest:*

GERALD J. MOSSINGHOFF

*Attesting Officer*

*Commissioner of Patents and Trademarks*